US005432406A

United States Patent [19]

Brooks

[11] Patent Number: 5,432,406

[45] Date of Patent: Jul. 11, 1995

[54] WIDE RANGE LOAD CURRENT REGULATION IN SATURABLE REACTOR BALLAST

[75] Inventor: Douglas W. Brooks, Carson City, Nev.

[73] Assignee: Bruce Industries, Inc., Dayton, Nev.

[21] Appl. No.: 120,950

[22] Filed: Sep. 14, 1993

[51] Int. Cl.[6] ..... H05B 39/00

[52] U.S. Cl. ..... 315/94; 315/96; 315/98; 315/99; 315/76; 315/DIG. 4; 315/DIG. 7

[58] Field of Search ..... 315/94, 96, 102, DIG. 4, 315/DIG. 7, 99, 98, 76

[56] References Cited

U.S. PATENT DOCUMENTS 4,413,209 11/1983 Roche ..... 315/96
4,998,046 3/1991 Lester ..... 315/DIG. 4

*Primary Examiner*—Robert J. Pascal
*Assistant Examiner*—Reginald A. Ratliff
*Attorney, Agent, or Firm*—Beehler & Pavitt

[57] ABSTRACT

A simple and compact magnetic ballast for powering a wide range of fluorescent lamp load Wattage such as 14 Watt to 60 Watt without need for modification to the ballast unit. Arc current to the lamp load is supplied through a saturable reactor including a power winding on a magnetic core. Arc current delivered to the lamp load is a function of magnetic saturation of the core determined by a control current through a control winding on the core. In one application, multiple fluorescent lighting fixtures of different wattages illuminating the interior of an aircraft cabin are each powered by essentially identical ballast units for easier installation and maintenance of the cabin lighting.

23 Claims, 2 Drawing Sheets

WIDE RANGE LOAD CURRENT REGULATION IN SATURABLE REACTOR BALLAST

BACKGROUND OF THE INVENTION

1. Field of the Invention

This invention relates to current ballasts for fluorescent lamps and more particularly relates to the application of saturable reactor type ballasts as universal ballasts for powering a wide range of lamp wattage loads.

2. State of the Prior Art

Fluorescent lamps are low pressure mercury arc discharge devices. A filament at each end of a sealed lamp tube is heated by a filament current, and a glow discharge is sustained by a sufficiently high lamp voltage applied across the lamp tube. Such a fluorescent lamp behaves as a negative impedance in that, as current increases through the lamp, its impedance decreases. Consequently, as the arc current is initially established between the filaments, the current must be externally limited to a safe operating level to avoid destruction of the lamp. A ballast is designed to supply the necessary lamp and filament voltages while limiting the arc current across the lamp to a level which provides optimum light output without damaging the lamp tube.

Many ballasts have been devised, which generally may be classified as magnetic ballasts and solid state ballasts. Magnetic ballast tend to be simple and rely on inductance effects for limiting the arc current through a fluorescent lamp. In its simplest form, a magnetic ballast is a single coil inductor wound on a magnetic core and connected in series with the lamp tube. Solid state ballasts have evolved into highly sophisticated electronic power circuits which rely on active semiconductor devices to provide very close regulation of both current and voltage through the lamp tube.

Simple magnetic ballasts tend to exhibit limited load current regulation. This means that the electrical characteristics of the ballast must be tailored to the specific lamp load wattage to be powered, e.g. 15 Watt, 30 Watt, 40 Watt, etc. The simplest ballasts such as the single series inductor type ballasts are typically designed for a specific lamp tube wattage and different ballasts are available for each commercially available lamp tube size. The more complex ballasts, on the other hand, have wider load current regulation capabilities, and a single ballast may be interchangeably connected for powering lamp loads which may vary by a factor of 3 or even 4. For example, a high performance electronic ballast may regulate lamp current to within 1 or 2 percent over a lamp load range of 4 to 80 Watt. The more elaborate ballasts typically feature a dimming control for adjusting the light output between a bright level and a subdued light output.

One particularly demanding ballast application is in fluorescent lighting of aircraft interiors, particularly the passenger cabin of large jet liners. In such applications, it is specially desirable that the ballast be of small size and light weight in order to improve the aircraft's passenger or cargo carrying capacity. Additionally, aircraft lighting ballasts must meet particularly stringent limits on spuriously generated electromagnetic interference (EMI) which can interfere with the aircraft's sensitive radio communication and navigation equipment. Low EMI operation is more readily achieved with the simpler inductive type ballasts which do not incorporate non-linear or switching devices, either of which is conducive to the generation of higher order harmonics of the aircraft power line frequency, and high frequency noise in general. Simple ballasts are, of course, desirable from an economic viewpoint, in that their cost is generally lower than that of the more sophisticated, solid state ballasts. On the other hand, aircraft lighting installations typically include lamp fixtures of rather widely different lamp wattage. The long, tubular interior of the passenger cabin is normally lit by fluorescent strips along the ceiling center and on each of the side walls of the cabin. The cabin interior is divided into segments of unequal length by transverse bulkheads and partitions necessitated by lavatories, galleys and other features and installations of the aircraft. As a result, the lighting strips are similarly divided into segments of uneven lengths which include lamp tubes of different lengths as needed to make up the required segments. Because of this and other considerations a typical large airliner requires ballasts capable of powering fluorescent lamp loads ranging from e.g. 14 Watt to as much as 80 Watt. Since a substantial number of these ballasts are required in a large airliner, it is desirable to use a single ballast type for all of the fluorescent lamp fixtures in order to standardize the ballast throughout the aircraft cabin with a view to simplifying the aircraft's design, construction and subsequent maintenance. Aircraft lighting also requires that the fluorescent lamps be dimmable from a bright light output level to a subdued level, so that cabin illumination can be adjusted by the crew to suit various stages of a flight. Bright illumination is needed prior to and during take-off and landing, for example, while dim illumination is desirable during sleep periods or while screening in-flight movies.

What is needed therefore is a ballast of simple, low cost configuration which features good load current regulation over a relatively wide range of lamp load wattage, and which is dimmable for adjusting the light output of the fluorescent lamps.

One type of simple, dimmable magnetic ballast is the saturable reactor ballast. A saturable reactor ballast consists of a ballasting inductor wound on the outer legs of an E-type magnetic core and connected in series with the fluorescent lamp load, and a control winding on the center leg of the same magnetic core. A control current through the control winding shifts the degree of magnetization of the core and consequently changes the effective inductance of the ballasting inductor. In practice, the ballasting inductor windings and the magnetic core are selected so that in the absence of a control current the ballasting inductance limits the arc current through the lamp load to a dim light output level. For full lamp brightness a D.C. current is applied through the control winding, the core is biased along the hysteresis curve towards magnetic saturation to maintain a degree of magnetization of the core which is then driven into magnetic saturation through some portion of every cycle of the A.C. lamp voltage through the ballasting inductor, in effect reducing the inductance of the ballasting inductor. As a result, a greater arc current is delivered to the lamp load, producing a brighter light output. As the current through the control winding is varied continuously, so the light output of the lamp load can be continuously adjusted from a dim level to full brightness.

Although saturable reactor ballasts have been known for many years, consistent industry practice has been to design and manufacture these ballasts for use with specific lamp load wattages. For example, Bruce Industries, of Dayton, Nev., owner of this application, has sold saturable reactor ballasts for over ten years as their 03980-** series in wattage ratings of 14/15/20, 30, 40, 2×30 and 2×40 Watt. This series of ballasts has always been installed in commercial passenger aircraft in accordance with their specified load rating.

SUMMARY OF THE INVENTION

This applicant has discovered that, contrary to current understanding and practice in the industry, saturable reactor ballasts are in fact capable of good wide range regulation of the lamp load current. This result is surprising in view of the simplicity of the saturable reactor ballast, and the fact that its mode of current regulation, aside from the control current and lamp dimming feature, is essentially similar to that of a single winding ballast, which is the simplest type of current ballast for fluorescent lamps. The saturable reactor ballast is in essence a single inductor, albeit one of variable inductance, connected in series with the lamp load. Good load current regulation would not be expected from such a simple ballast arrangement, and in fact these capabilities of the saturable reactor ballast have remained undiscovered until now, notwithstanding the many years of commercial use of this type of ballast.

This applicant's invention includes installation of a single saturable reactor ballast design or part number in each of different fluorescent lamp fixtures installed through the interior cabin of an aircraft, the lamp fixtures being characterized by substantially different wattage of the fluorescent lamp loads in the various lamp fixtures. In particular, the fixtures may include lamp loads ranging from 14 Watt to at least 60 Watt.

DETAILED DESCRIPTION OF THE PREFERRED EMBODIMENTS

Figure 1:
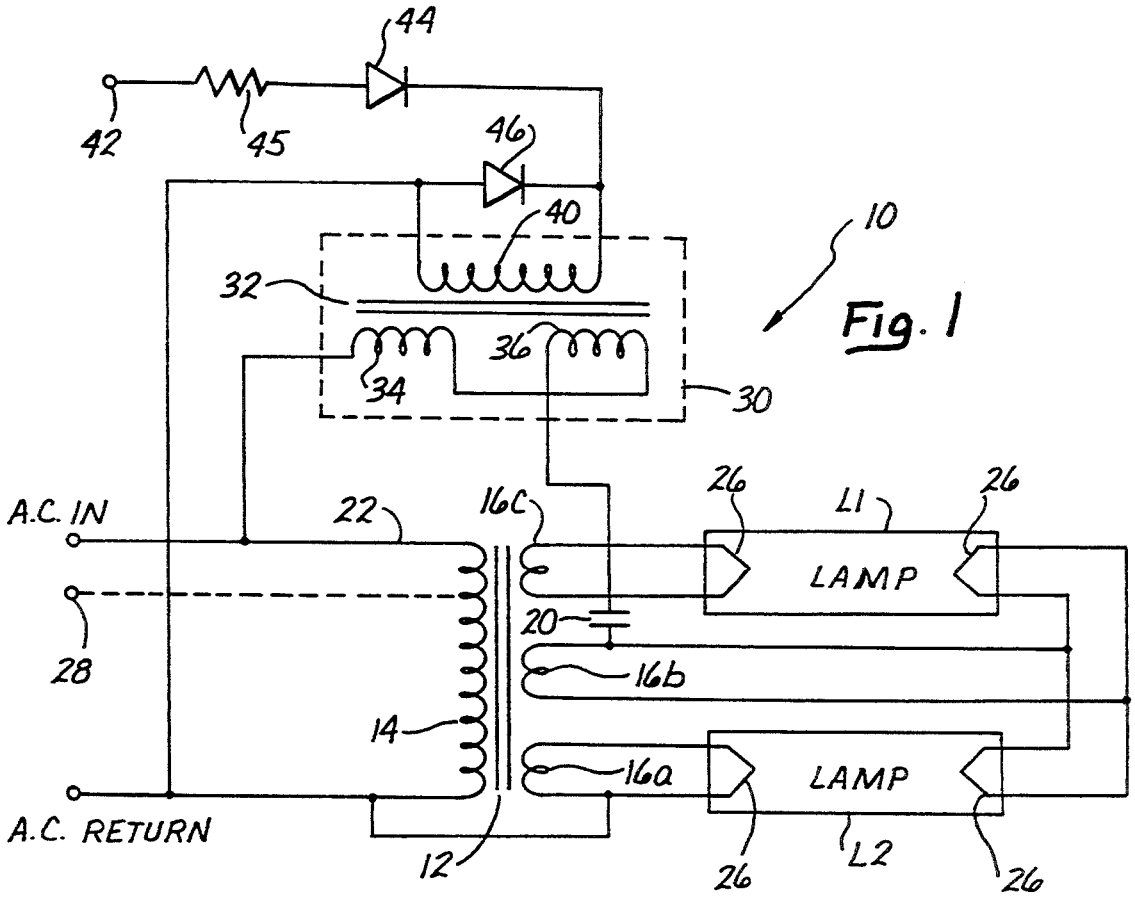
FIG. 1 is a circuit diagram of the saturable reactor ballast as implemented according to this invention.

With reference to the drawings, FIG. 1 shows a circuit diagram of a saturable reactor ballast which is generally designated by the numeral 10. A power transformer 12 has a primary winding 14 and three secondary filament windings 16*a*, 16*b*, and 16*c*. The power mains input is connected between a ground end 18 and a high end 22 of the primary winding. The top and bottom secondary windings 16*a*, 16*c* are connected across a corresponding heater filament 26 at opposite ends of two fluorescent lamp tubes L1, L2 for providing appropriate filament current. The other two filaments of the two lamp tubes are connected in parallel with each other and are supplied with filament current by filament winding 16*b*.

Figure 2:
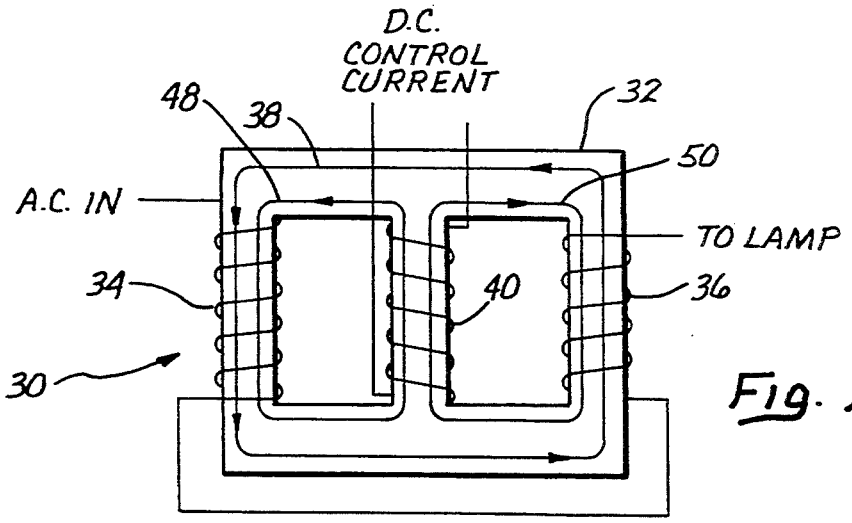
FIG. 2 is a diagram of a saturable reactor of the type incorporated in the ballast of FIG. 1.

The high voltage end 22 of the primary winding 14 is connected to an input side of a saturable reactor generally designated by the numeral 30. The saturable reactor has a E-core 32, illustrated in FIG. 2. A ballasting inductance is made up of two coil windings 34, 36 wound on the two outer legs of the E-core, as shown in FIG. 2, so as to cooperate in maintaining an alternating current flux path around the outer parameter of the E-core, as indicated by numeral 38. The output side of the ballasting inductor is connected to the high side of filament winding 16*c*. The bottom side of the filament winding 16*a* is connected to the return end 18 of the primary winding 14. The A.C. line voltage input to the ballast is therefore applied through the windings 34, 36 and across both lamps L1, L2 which for purposes of the arc voltage are connected in series between the filament windings 16*a* and 16*c*, so that an arc current is established through both lamp tubes by the A.C. line voltage. In the case where only one lamp tube is to be powered by the ballast 10, the lamp tube is connected between the 16*a* and 16*c* filament secondary windings, the middle secondary being unused.

The saturable reactor 30 also includes a control winding 40 wound about the center leg of the E-core 32. A variable A.C. dim control input 42 is rectified through diodes 44, 46 to provide a D.C. control current through the winding 40. The control current flows through coil 40 so as to establish D.C. flux loops 48, 50. A change of current in the D.C. coil 40 causes a change in total magnetic flux linking the A.C. power coils 34, 36 and hence a change in the inductance of the two A.C. power coils. This in turn results in a change in the A.C. arc current delivered to the lamp load L1, L2. The D.C. control current to the saturable reactor is derived from a variable A.C. control voltage of 0–115 Volts, through 560 Ohm current limiting resistor 45 and rectified by the two diodes 42, 44. The variable A.C. voltage is supplied by a light level control, such as a Variac power transformer, not shown in the drawings, common to some or all of the ceiling and wall light fixtures in the aircraft cabin.

Within a design range of the saturable reactor 30, the control voltage through the winding 40 may be varied continuously to achieve a corresponding continuous change in the arc current through the lamp load with a corresponding variation in the light output of the lamp. The E-core 32 may be configured using 2 pairs of "C" cores such as sold by Magnetic Metals, Inc., Westminster, Calif., as their part number MZ30D, with 1,100 turns of 27 ga. wire on each of the outer legs for windings 34, 36, and 10,000 turns of 37 ga. wire on the center leg for the control winding 40. The control current varies the inductance of the ballasting coils 34, 36 by a factor of about 10, e.g. from 1–2 Henrys for an unsaturated condition of the core with no current through winding 40 for dimmest light output, to 100–200 milli-Henrys for normal, bright lamp operation with the core saturated at maximum control current.

The ballast circuit of FIG. 1 has been sold by Bruce Industries, the owner of this invention, as a commercial product for over ten years, under part number 03980-xx, where the "xx" stands for a two digit "dash number". Saturable reactor ballasts have been long used in aircraft cabin fluorescent lighting systems, and such ballasts are available through sources other than Bruce Industries. Up until now, however, Bruce Industries as well as others in the aircraft interior lighting industry have consistently designed and sold saturable reactor ballasts as "single dash number" parts, meaning that a particular ballast was intended for use with a specific lamp wattage load, e.g. 60 Watt. Consequently, saturable reactor ballasts have been used and installed in accordance with the manufacturer's specifications in lighting fixtures for powering the specified lamp load. The various "dash number" ballasts differ chiefly in their arc voltage output to the lamps, as shown in the following Table 1.

TABLE 1

Bruce Industries Single Dash Number Saturable Reactor Ballasts

| 3980 Dash # | Qty. lamps | Lamp type | Total load Watts | Open circuit Volts | Filament volts D/C |
|---|---|---|---|---|---|
| −10 | 2 | F30T12 | 60 | 260–300 | 3.6–4.4 |
| −60 | 1 | F40T12 | 40 | 220–240 | 3.6–4.4 |
| −30 | 1 | F30T12 | 30 | 160–180 | 3.6–4.4 |
| −20 | 2 | F20/15/14 T12 | 40/30/28 | 240–260 | 7.6–8.4 |
| −40 | 1 | F20/15/14 T12 | 20/15/14 | 190–210 | 7.6–8.4 |

All of the ballasts listed in Table 1 operate on 230 Volts A.C., 400 Hz standard aircraft power. The different open circuit lamp voltages at the ballast output are obtained by means of an appropriate power transformer connected between the A.C. line mains and the saturable reactor 30. Likewise, the filament windings of the ballast provide the different filament voltages shown in the Table above. Both the open circuit lamp and filament voltages are selected in compliance with ANSI (American National Standards Institute) standards for the particular fluorescent lamp tubes.

This applicant has discovered that, contrary to many years of accepted practice in the industry, saturable reactor ballasts are capable of good load current regulation over a rather wide range of lamp wattage loads, so that a "universal" ballast of this type can replace the several "single dash" ballasts currently required. This capability for the ballast 10 of FIG. 1 is illustrated in the following Table 2, for lamp loads ranging from 15 to 60 Watt. Each wattage load was tested in four trials with different lamp tubes in each trial. A.C. line input to the ballast 10 was 230 Volts A.C. 400 Hz, with the reactor 30 at full saturation for lamp operation at maximum brightness.

TABLE 2

Universal Saturable Reactor Ballast Performance

| Lamp load | trial # | Foot Candles | Lamp Ic | Crest F. |
|---|---|---|---|---|
| F30T12 × 2 | 1 | 270–274 | 278 | 1.51 |
| | 2 | 267–272 | 278 | |
| | 3 | 287 | 278 | |
| | 4 | 273–278 | 278 | |
| F40T12 × 1 | 1 | 269–271 | 289 | 1.59 |
| | 2 | 264–267 | 289 | |
| | 3 | 269–276 | 289 | |
| | 4 | 269–272 | 286 | |
| F20T12 × 1 | 1 | 257–265 | 294 | 1.61 |
| | 2 | 258–269 | 293 | |
| | 3 | 256–266 | 292 | |
| | 4 | 255–270 | 292 | |
| F15T12 × 1 | 1 | 228–239 | 294 | 1.62 |
| | 2 | 258–260 | 293 | |
| | 3 | 245–252 | 294 | |
| | 4 | 236–239 | 293 | |

As may be seen, the lamp load current $I_c$ varies by only 16 mA over the full load range, a variation of less than 6 percent. At the same time, the power crest factor, an important indicator of ballast performance, varies by about 10 percent over the tabulated load range. The crest factor is defined as the ratio of the peak current to the R.M.S. current wave form through the lamp load. The crest factor is directly related to, and inversely proportional to the light output of a fluorescent lamp. Table 2 above also shows the result of photometric testing of the fluorescent lamp tubes of different wattages while powered by the same ballast 10 of FIG. 1. The light output per unit length of the various lamp tubes varies by about 25%, a variation which is difficult to appreciate to the casual observer. Such a difference would not be readily noticeable as between lamp tubes in a lighting strip along an aircraft passenger cabin. By comparison, the following Table 3 shows the load regulation performance of a typical conventional 40 Watt series inductor ballast consisting of a single winding on a toroidal magnetic core.

TABLE 3

Load Current Regulation of Conventional Toroidal Winding 40 Watt Ballast

| Lamp load | Lamp Current | Crest Factor |
|---|---|---|
| F30T12 × 2 | 300 mA | 1.4 |
| F40T12 × 1 | 365 mA | 1.4 |
| F20T12 × 1 | 401 mA | 1.5 |
| F15T12 × 1 | 408 mA | 1.5 |

It is readily apparent that the saturable reactor ballast 10 provides much better load current regulation than a conventional series inductor ballast. The load regulation testing of Table 2 above was conducted with the lamp load at full brightness, i.e. with the reactor core magnetically saturated. In operation at full lamp brightness the saturable reactor control current is at a maximum to minimize the reactance of the reactor's magnetic core. While Table 2 tabulates lamp loads up to 60 watts, comparable current regulation capability of the ballast 10 extends up to fluorescent lamp loads of at least 80 watts.

The universal ballast 10 according to this invention, in the preferred embodiment illustrated in FIG. 1, does not employ a step-up transformer to raise the 230 Volt A.C. aircraft line voltage input to the ballast 10. Transformer 12 is a filament transformer only, and the voltage applied to the lamp load L1, L2, with the saturable reactor 30 at minimum impedance, is substantially the 230 V.A.C. input to the ballast 10. The three filament windings **16*a*, 16*b* and 16*c* each deliver 4.5 volts to the lamp filaments. Reference to Table 1 shows that the open circuit lamp voltage of about 230 Volts provided by the universal ballast 10 is somewhat lower than the open circuit voltage delivered by the prior "−60" ballast. This difference tends to reduce the ability to strike the lamp tubes at low temperatures, e.g. below 50 degrees F. However, the slightly higher filament voltage of the universal ballast 10 over that of the −50 unit tends to improve the lamp striking ability of the ballast and compensates for the lower open circuit voltage. Also, The 4.5 volt filament voltage and the nominal 230 open circuit voltage of the universal ballast 10, while a departure from the ANSI standards for some of the lamp tubes in Table 1, is a reasonable compromise, and to the extent that the service life or optimum lamp performance may be affected by such departure, the benefits derived from the universality of ballast 10** outweigh any slight changes in lamp performance.

Lamp loads consisting of two lamp tubes are more difficult to start than single tube loads of comparable wattage. In order to improve lamp starting ability the ballast 10 makes use of a starting aid capacitor 20 connected between the high side of the center filament winding **16*b* and the high side of the upper filament winding 16*c*, as shown in FIG. 1. During start up of a dual lamp tube load, capacitor 20 presents a momentary low impedance between the two filament windings so that the full open circuit voltage output of the saturable reactor 30 is applied to the middle filament winding 16*b*, bypassing the upper filament winding 16*c*. The effect is that the open circuit voltage is applied only across one of the two lamp tubes, namely the lamp tube L1 which is connected between the lower and the middle filament windings 16*a* and 16*b*. The capacitor 20 charges quickly and as its impedance becomes high the high voltage then appears on the upper filament winding 16*c*, which starts the second lamp tube L2 of the lamp load. In a presently preferred circuit, the capacitor 20 is 0.01 microFarads. This device avoids the need for a step-up transformer in ballast 10 to provide voltage sufficient to start both lamp tubes. It is however, within the scope of this invention, in an alternate embodiment of the ballast 10, to eliminate the starting aid capacitor 20, and to provide a step-up transformer for delivering a voltage to the saturable reactor higher than the available A.C. line voltage. The step-up transformer may be either a separate transformer with a high voltage secondary, or an auto transformer winding integrated with the primary winding of the filament transformer 12. This latter option is suggested by the dotted line input 28, which would then receive the A.C. line input to the primary winding 14 of the filament transformer 12 in FIG. 1, in lieu of the input to the high end 22 of the primary shown in solid line in FIG. 1, thereby delivering a stepped-up voltage to the saturable reactor 30**.

Figure 3:
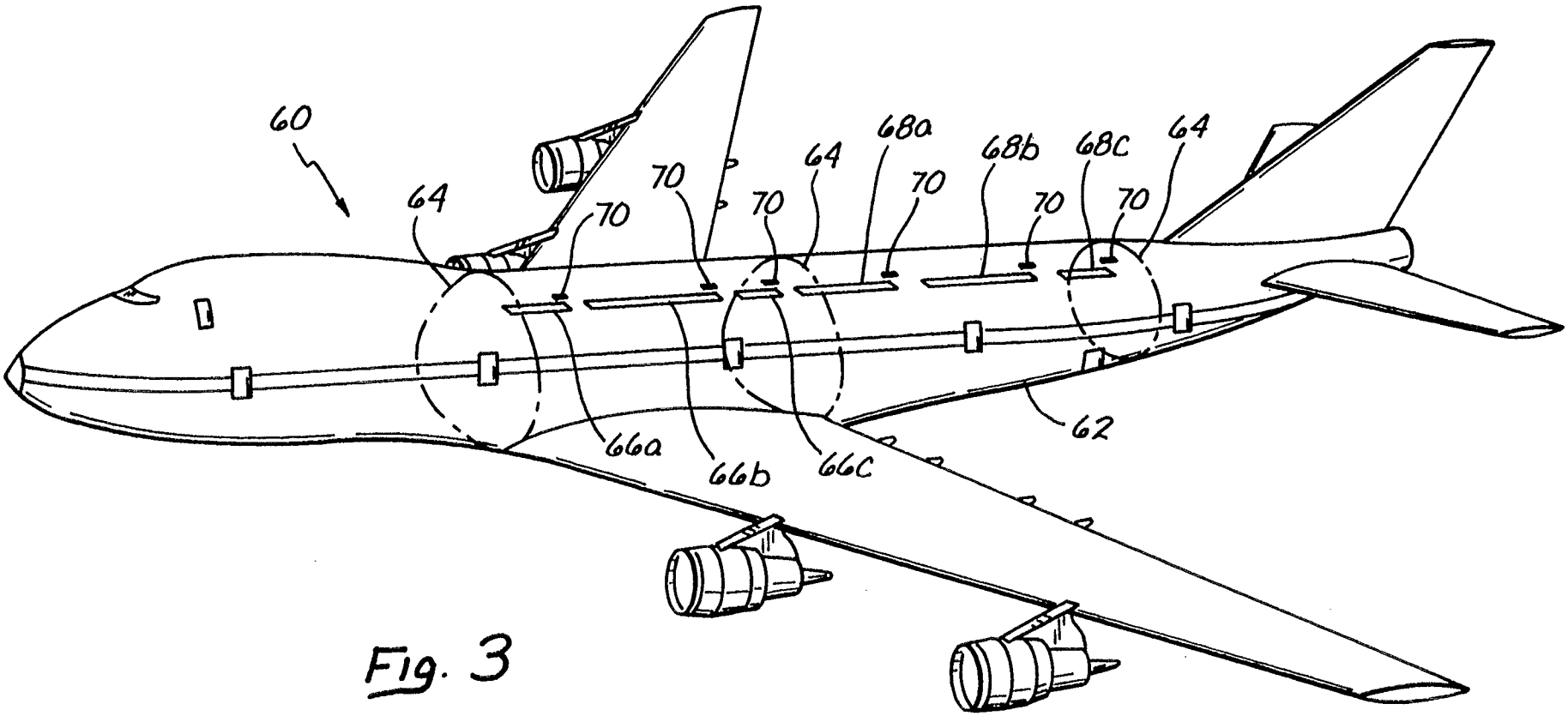
FIG. 3 is shows a typical jet airliner illustrating in greatly simplified form an arrangement of fluorescent lighting fixtures making-up a lighting strip along the ceiling of the passenger cabin, each fixture including a ballast.

FIG. 3 shows a large passenger airliner 60 with a fuselage 62, which defines a passenger cabin extending nearly the entire length of the fuselage. The passenger cabin is divided into segments of uneven length by internal bulkheads 64 indicated in phantom lining. The interior of the passenger cabin is illuminated by a complex lighting system, which in the interest of clarity and simplicity is reduced in FIG. 3 to a single lighting strip along the cabin ceiling. As illustrated, the lighting strip consists of fluorescent lamp fixtures **66*a*, 66*b*, 66*c*, in one segment of the passenger cabin, and fixtures 68*a*, 68*b* and 68*c* in an adjacent segment of the passenger cabin. Each lamp fixture is powered by its own ballast 70. The length of the cabin segments between the internal bulkheads 64 of the fuselage 62 is determined by structural considerations and without regard to the dimensions of the lamp fixtures 64, 68. Since fluorescent lamp tubes are available in standard lengths, the length of the lighting strip segment between consecutive bulkheads 64 must be made up by a suitable combination of commercially available lamp tube lengths, necessitating the use of lamp fixtures which are of different wattage to make up the lighting strip. For example, fixtures 64*a* and 64*c* are shorter than the middle fixture 64*b* in that cabin segment. Consequently, the shorter fixtures will use lamp tubes of lower wattage than the longer fixture. Similarly, fixtures 66*a* and 66*b* are of similar length to each other, but longer than fixture 66*c***. The latter therefore is of lower lamp wattage than the other two fixtures in that cabin segment. Industry practice concerning aircraft interior lighting installations based on saturable reactor ballasts is to equip each fluorescent light fixture with a ballast specifically designed to power the particular load wattage presented by that fixture, as was explained above. This practice calls for as many different ballast part numbers in an aircraft as there are fluorescent lamp fixtures of different wattage. In an actual large passenger airliner, this could mean a half-dozen different ballast part numbers which must be specified, purchased, kept in inventory and installed in the aircraft. Subsequently, during the service life of the aircraft, as replacements are needed, the appropriate ballast dash number must be obtained and installed. The resulting complexity adds to the cost and difficulty of construction and maintenance of the aircraft.

By substituting the universal saturable reactor ballast 10 as disclosed herein, the lighting installation in passenger airliners and other aircraft can be greatly simplified and its subsequent maintenance made easier and more economical in that only a single ballast part number needs to be ordered, kept in inventory and installed in any of the fluorescent fixtures in the aircraft which previously required different ballast specifications.

While a preferred embodiment of the invention has been described for purposes of clarity and example, it must be understood that many changes, substitutions and modifications to the described embodiment will be apparent to those possessed of ordinary skill in the art without thereby departing from the scope and spirit of the present invention, which is defined by the following claims.

What is claimed is:

1. An aircraft having a cabin and a plurality of interior lighting fixtures installed throughout said cabin, each said fixture having a ballast for powering a fluorescent lamp load in said fixture, said ballast comprising filament supply means for delivering heating current to filaments in said lamp load and load current supply means for providing lamp current between said filaments, said load current supply means having saturable reactor means including a magnetic core, power winding means on said core connected for delivering an arc current to said lamp load, and control means operative for setting the magnetic saturation of said magnetic core thereby to determine the lamp current delivered to said lamp load by said power winding means;

characterized in that different ones of said lighting fixtures include lamp loads ranging from 14 Watt to 60 Watt, and said ballast is of substantially identical construction in each said fixture.

2. The aircraft of claim 1 wherein said ballast has a primary transformer winding, and said power winding means are connected in series with said primary transformer winding.

3. The aircraft of claim 2 wherein said ballast has a plurality of secondary filament windings, said lamp load being connected between said filament windings, one of said filament windings is connected to one end of said power winding means, one end of said primary winding is connected to another end of said power winding means, and another end of said primary winding is connected to another of said filament windings.

4. The aircraft of claim 3 wherein said control means include a control winding on said core of said saturable reactor.

5. The aircraft of claim 4 wherein said power winding means comprise first and second power windings on a common core, said control winding also being on said common core.

6. The aircraft of claim 4 wherein said control means further comprise means for supplying a control voltage to said control winding thereby to vary the magnetic saturation of said core and consequently the current delivered to said lamp load.

7. An aircraft having a cabin and a plurality of interior lighting fixtures installed throughout said cabin, each said fixture having a ballast for powering a fluorescent lamp load in said fixture, said ballast comprising filament transformer means including a plurality of filament windings for delivering heating current to filaments in said lamp load, a saturable reactor for adjusting the lamp current delivered to said lamp load, said saturable reactor having first and second power windings on a common core and connected in series with said lamp load for providing a lamp arc voltage, a control winding on said common core, control means for supplying a variable control current to said control winding thereby to control current through said lamp load, characterized in that said lamp load in different ones of said lighting fixtures include at least two different wattages selected from the group comprised of: a lamp of 14 Watt to 20 Watt, a 30 Watt lamp, a 40 Watt lamp and a pair of lamps comprising any two of said lamps, and said ballast is of substantially identical construction in each said fixture.

8. The aircraft of claim 7 further comprising starting aid means for sequentially applying starting voltage to a plurality of lamps constituting said lamp load.

9. The aircraft of claim 8 wherein said starting aid means comprises starting aid capacitor means connected between two of said filament windings.

10. The aircraft of claim 7 wherein said filament windings each deliver substantially 4.5 volts to the filaments of said lamp load.

11. The aircraft of claim 7 wherein said ballast provides an open circuit voltage of approximately 230 volts A.C. to said lamp load.

12. The aircraft of claim 7 wherein said control means further comprise common light control means for supplying a control voltage to said control winding of said ballast in each of said fixtures.

13. An aircraft having a cabin and a plurality of interior lighting fixtures installed throughout said cabin, each said fixture having a ballast for powering a fluorescent lamp load in said fixture, said ballast comprising filament supply means for delivering heating current to filaments in said lamp load and load current supply means for providing lamp current between said filaments, said load current supply means including saturable reactor means having a magnetic core, power winding means on said core connected for delivering an arc current to said lamp load, a control winding and variable control current supply means operative for varying the magnetic saturation of said magnetic core thereby to adjust the lamp current delivered to said lamp load by said power winding means;

characterized in that said lamp load in different ones of said lighting fixtures include at least two different wattages selected from the group comprised of: a lamp of 14 Watt to 20 Watt, a 30 Watt lamp, a 40 Watt lamp and a pair of lamps comprising any two of said lamps, and said ballast is of substantially identical construction in each said fixture and is operative for powering said different wattages without modification to said ballast.

14. A ballast for powering a fluorescent lamp load selected from the group comprised of 14 Watt, 15 Watt, 20 Watt, 30 Watt, 40 Watt lamps or any pair of said lamps, said ballast comprising filament transformer means including a plurality of filament windings for delivering heating current to filaments in a said lamp load, a saturable reactor having first and second power windings on a common core and connected in series with a said lamp load for providing a lamp voltage, a control winding on said common core, one of said filament windings connected to one end of said power winding means, one end of said primary winding connected to another end of said power winding means, and another end of said primary winding connected to another of said filament windings.

15. The ballast of claim 14 further comprising starting aid means for sequentially applying starting voltage to a plurality of lamps constituting a said lamp load.

16. The ballast of claim 15 wherein said starting aid means comprises starting aid capacitor means connected between two of said filament windings.

17. The ballast of claim 14 wherein said filament windings each deliver substantially 4.5 volts to the filaments of a said lamp load.

18. The ballast of claim 14 wherein said ballast provides an open circuit voltage of approximately 230 volts A.C. to a said lamp load.

19. The ballast of claim 14 wherein said control means further comprise light control means for supplying a control voltage to said control winding.

20. A ballast for powering a fluorescent lamp load, said ballast comprising filament transformer means including a plurality of filament windings for delivering a filament voltage to each filament in a said lamp load, starting aid means connected between said filament windings for sequentially applying starting voltage to a plurality of lamps constituting a said lamp load, arc voltage supply means including a saturable reactor having power winding means on a magnetic core for providing an open circuit voltage to a said lamp load, a control winding on said core, and means for supplying a control current to said control winding for setting a level of magnetic saturation of said core thereby to determine the lamp current delivered to said lamp load, characterized in that said ballast can be connected for adequately powering a said lamp load selected from the group comprised of 14 Watt, 15 Watt, 20 Watt, 28 Watt, 30 Watt, 40 Watt and 60 Watt lamp loads, or lamp load wattages intermediate thereto, without modification to said ballast.

21. The ballast of claim 20 wherein said open circuit voltage is of approximately 230 volts A.C and said filament voltage is nominally 4.5 volts.

22. The ballast of claim 20 wherein said arc voltage supply means comprise step-up transformer means connected to said saturable reactor for raising said open circuit voltage above an A.C. line input voltage to said ballast.

23. A magnetic ballast for powering a fluorescent lamp load, said ballast comprising filament supply means for delivering heating current to filaments in said lamp load and load current supply means for providing lamp current between said filaments, said load current supply means having saturable reactor means including a magnetic core, power winding means on said core connected between a power source and said lamp load for delivering an arc current to said lamp load, and control means operative for setting the magnetic saturation of said magnetic core thereby to determine the lamp current delivered to said lamp load by said power winding means;

characterized in that said ballast is operative for powering a said lamp load selected from the group comprised of 14 Watt, 15 Watt, 20 Watt, 28 Watt, 30 Watt, 40 Watt and 60 Watt lamp loads, or lamp load wattages intermediate thereto, without modification to said ballast.

* * * * *